US006733198B1

(12) United States Patent
Hünniger

(10) Patent No.: US 6,733,198 B1
(45) Date of Patent: May 11, 2004

(54) APPARATUS FOR TRANSPORTING SINGLE SHEETS THROUGH A DEVICE FOR EXPOSING OR PRINTING THE SINGLE SHEETS

(75) Inventor: Heinrich Hünniger, Gumperda (DE)

(73) Assignee: AGFA-Gevaert AG, Leverkusen (DE)

( * ) Notice: Subject to any disclaimer, the term of this patent is extended or adjusted under 35 U.S.C. 154(b) by 0 days.

(21) Appl. No.: 09/695,444

(22) Filed: Oct. 24, 2000

(30) Foreign Application Priority Data

Dec. 23, 1999 (DE) ..... 199 62 776

(51) Int. Cl.[7] ..... B65H 5/02

(52) U.S. Cl. ..... 400/629; 101/232; 271/275; 355/47; 355/72; 396/612; 396/618

(58) Field of Search ..... 101/232; 400/629; 355/47, 72, 73; 271/275, 272; 396/612, 618

(56) References Cited

U.S. PATENT DOCUMENTS 3,754,826 A * 8/1973 Kobayashi et al. ..... 271/226
3,941,375 A * 3/1976 La White et al. ..... 271/251
4,087,177 A * 5/1978 Gumm et al. ..... 271/196
4,139,190 A * 2/1979 Keyt et al. ..... 271/183
4,157,058 A * 6/1979 Vogel ..... 493/124
4,320,963 A * 3/1982 Satomi ..... 188/77 R
4,659,073 A * 4/1987 Leonard ..... 271/254
4,737,826 A * 4/1988 Magka ..... 355/104
5,678,119 A 10/1997 Tamaki ..... 396/618
5,855,368 A * 1/1999 Middelberg et al. ..... 271/272
6,481,710 B2 * 11/2002 Enders et al. ..... 271/275

FOREIGN PATENT DOCUMENTS

DE 196 36 235 9/1996

OTHER PUBLICATIONS

3–83668 Apr. 9, 1991 Japanese Abstract.
3–247473 Nov. 5, 1991 Japanese Abstract.
Meyers Lexikon der Technik und der exakten Naturwissenschaften.

* cited by examiner

*Primary Examiner*—Andrew H. Hirshfeld
*Assistant Examiner*—Kevin D. Williams
(74) *Attorney, Agent, or Firm*—Darby & Darby

(57) ABSTRACT

An apparatus for transporting single sheets through a device for exposing or printing the single sheets, with a drum and means that press the single sheets against the drum, with a processing station having a processing gap, with the single sheets being exposed or printed in the processing station, includes means that limit the processing gap. According to the invention, a belt unit is provided that presses the single sheets against the drum, with the belt unit having a plurality of parallel extending continuous belts that are mutually decoupled in their movement and can be driven exclusively directly or indirectly through coupling with the drum surface.

10 Claims, 2 Drawing Sheets

APPARATUS FOR TRANSPORTING SINGLE SHEETS THROUGH A DEVICE FOR EXPOSING OR PRINTING THE SINGLE SHEETS

BACKGROUND OF THE INVENTION

1. Field of the Invention

The present invention relates to an apparatus for transporting single sheets through a device for exposing or printing single sheets in a processing station. The apparatus includes a drum and pressing means for pressing the single sheet against the drum. The processing station is designed with a processing gap which includes means for limiting the processing gap.

2. Description of the Related Art

DE 196 36 235 A1 discloses an apparatus for recording information on photographic material that can be thermally developed. The apparatus includes a heated drum which deflects each single sheets by approximately 180°. In a first segment of the deflection, the single sheet is urged against the drum by four pressure rollers. An exposure gap is located between these pressure rollers, with a laser recording on the single sheet through this gap. After the exposure step, the pressing operation is taken over by a continuous belt which wraps around the drum in this stage of the deflection. The continuous belt is provided to maintain the single sheets in close contact with the drum so as to ensure an optimal heat transfer between the drum and the single sheet.

SUMMARY OF THE INVENTION

It is the object of the invention to form pressing means for pressing single sheets against a drum, so that single sheets with different formats, in particular with different widths, can be transported past a processing gap with a continuous, jerk-free motion, while simultaneously preventing jamming or canting of the sheets.

The object is solved by an apparatus for transporting single sheets through a device for exposing or printing single sheets in a processing station. The apparatus includes a belt unit for pressing the single sheets against the drum. This belt unit incorporates several parallel extending continuous belts which are mutually decoupled in their movement and which can be driven exclusively directly or indirectly through coupling with the drum surface. Accordingly, different formats can be exposed using, for example, a laser exposure device by decoupling the individual continuous belts of the belt unit. It does not matter if the single sheet is pressed against the drum by all belts of the belt unit or if some of the outer belts make direct contact with the drum. Since each belt can individually adapt to the thickness of the single sheet, the single sheet is also prevented from moving, rotating or slipping.

In an advantageous embodiment, respective belt units are provided in the transport direction of the single sheets both in front of and behind the processing gap, so that each single sheet is pressed against the drum over the entire wrap angle by independent continuous belts—with the exception of the width of the exposure gap. All continuous belts are decoupled from each other and only driven by the drum, so that the same forces act on the single sheets in front of and behind the exposure gap.

To keep the surface pressure on the single sheets which may consist, for example, of light sensitive photographic paper, as low as possible, the individual continuous belts of the belt units are formed as flat belts.

Each continuous belt is tensioned between two deflection rollers so as to contact the drum surface between these deflection rollers. The two deflection rollers are mounted so as to form an approximately L-shaped tapered gap between the flat belts and the drum surface. A third deflection roller for each of the continuous belts is positioned so as to turn around the portion of the continuous belts which is not in contact with the drum. The position of this deflection roller is not fixed; instead, the deflection roller can move in a direction where the force acting on the deflection roller can tension the belt. In this way, each continuous belt presses with an approximately identical pressure against the drum surface, regardless if a thick or a thin single sheet or no sheet at all is placed between the drum surface and the continuous belts.

Advantageously, the stationarily deflection rollers for the individual continuous belts can be arranged on a common.

In addition, a belt unit for each continuous belts may comprise two stationarily installed deflection rollers and a deflection roller with a spatially adjustable rotation axis. Also, a force is applied to the deflection roller with the spatially adjustable rotation axis in a direction that tensions the continuous belt. The stationarily installed deflection rollers form a respective gap with the drum when the continuous belt is applied, with the gap being wider than the thickest single sheet to be processed. In addition, the continuous belts between the stationarily installed deflection rollers wrap around the drum with an angle of greater than 40 degrees.

Advantageously, the diameter of the drum can be selected to be no less than 150 mm. For smaller diameters, for example, photographic paper could exert a force on the belt units due to its internal stress, which could prevent the paper from reliably contacting the drum.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
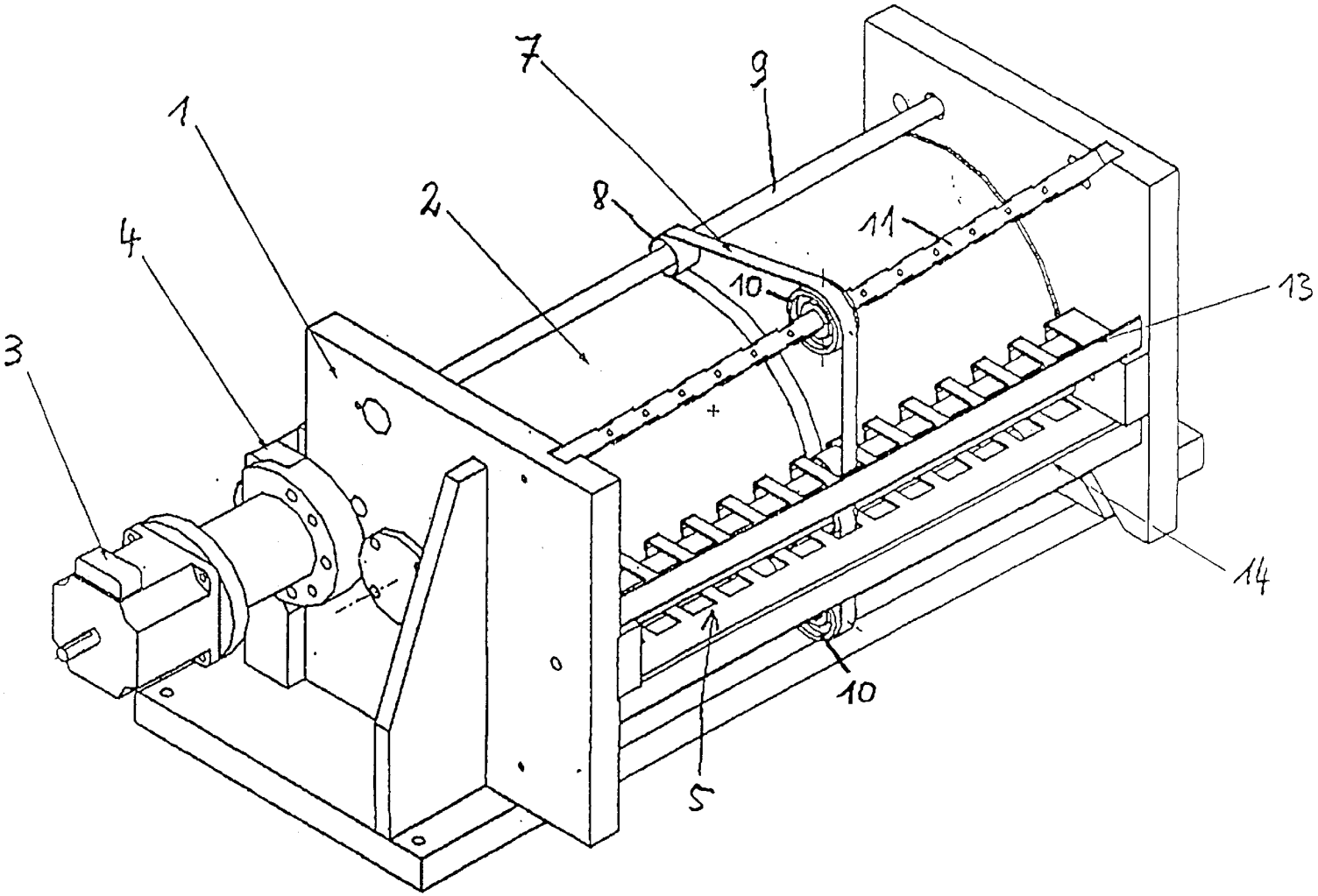
FIG. 1 is a perspective schematic representation of a laser exposure unit for photographic paper according to the invention.
Figure 3:
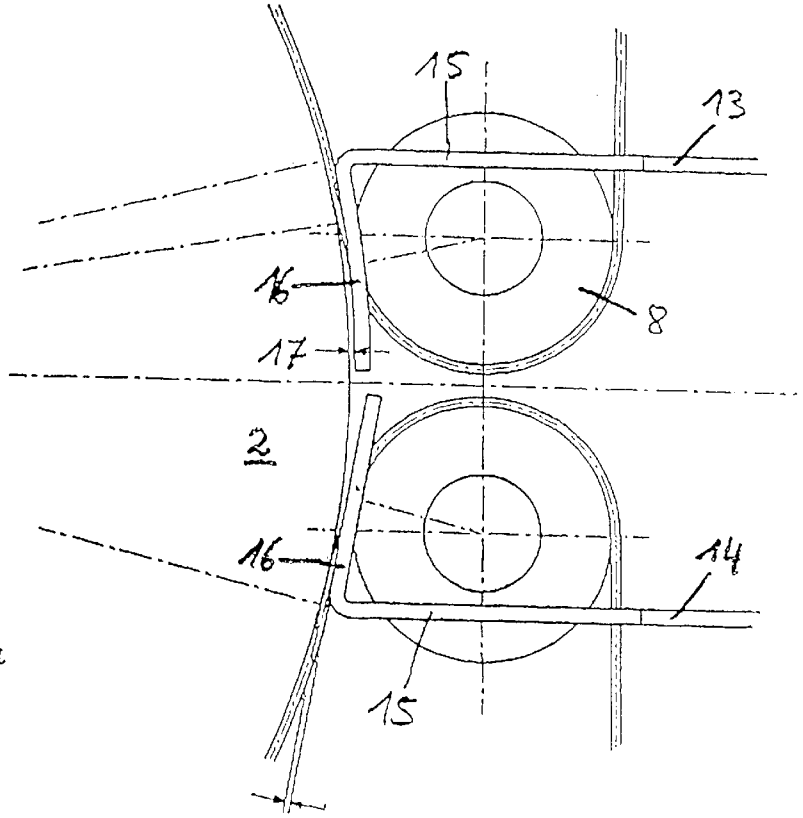
FIG. 3 is an enlarged detail of FIG. 2.

Referring now to the laser exposure device illustrated in FIG. 1, a print drum 2 is supported in a frame 1. The print drum is driven by a motor 3. A friction gear 4 is installed between the motor and the print drum, wherein the friction gear 4 converts the fast rotation of the motor axis into a slower, but exceptionally uniform rotation of the print drum.

Respective belt units 6 that keep the single sheets in contact with the print drum are provided on either side of the exposure gap 5. For sake of clarity, only one of the belt units 7 is shown. The respective belts are tensioned by two stationary deflection rollers 8. Parallel deflection rollers are each supported on a carrier 9.

The deflection rollers of the belt unit that are positioned before the exposure gap in the transport direction of the single sheets and form the front-feed device for the single sheets to the print drum, have a somewhat greater spacing from the drum surface than the other deflection rollers and thereby form with the print drum a tapered front-feed gap 18. The gap 18 can reliably receive also thicker single sheets, even if the front edge deviates slightly from their nominal position.

Tension rollers 10 apply a predefined tension to each belt, so that each belt always presses with the same force against the drum surface, regardless if a thick or thin paper or no paper at all is positioned on the print drum.

Figure 2:
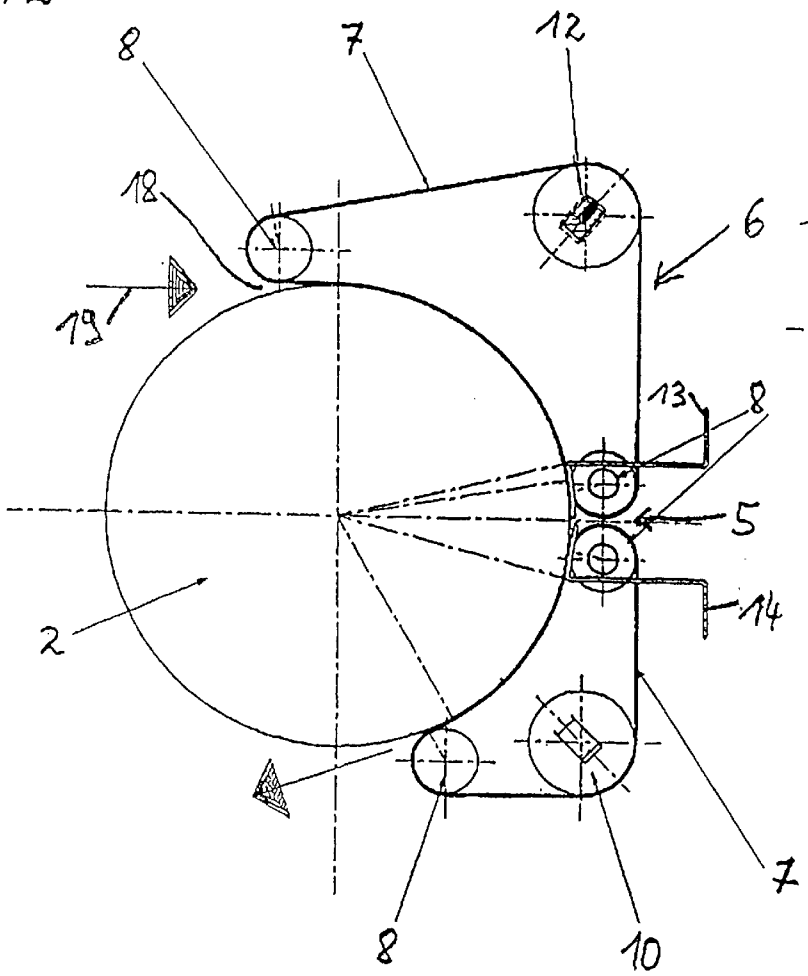
FIG. 2 is a cross-section through the apparatus of FIG. 1.

Parallel tension rollers are also supported on a common support 11, with a respective spring 12 urging each bearing against the support in the tensioning direction (see FIG. 2).

The individual belt assemblies do not have a drive and are moved exclusively by the print drum.

The exposure gap 5 is bounded by two comb-like guide plates 13, 14, with the teeth 15 of the guide plates 13, 14 extending through the belt assemblies. Each tooth has a lower leg 16 extending approximately parallel to the surface of the print drum. The gap 17 between the print drum and each of the tooth legs corresponds approximately to the thickness of the thickest photographic paper to be processed.

Both guide plates are moveable, so that the free ends of the tooth legs 16 can be lifted from the drum surface, thereby producing a tapered gap between the legs and the print drum.

When a single sheet is supplied to the front-feed gap 18 in the direction of the arrow 19, a gap is formed between the flat belts of the front belt unit and the print drum across the width of the single sheet. The adjacent belts continue to contact the drum surface directly. By decoupling the individual belt assemblies, transverse or twisting forces acting on the single sheet are eliminated, so that the sheet is transported totally straight and uniformly.

Before the leading edge of the single sheet reaches the deflection rollers of the first belt unit which are located directly before the exposure gap 5, the guide plate 13 which is also located before the exposure gap, is moved, so that the lower leg 16 extends approximately parallel to the drum surface. The guide plate 14 located after the exposure gap, on the other hand, is brought into a position where it's lower leg forms a tapered gap with the drum surface.

The first guide plate 13 thereby maintains the close contact between the leading edge of the single sheet and the print drum. The leading edge is lifted slightly from the drum surface only after passing the actual exposure gap 5. The leading edge is immediately and gently captured by the second guide plate 14 and again pressed against the print drum in the tapered gap. The extremely accurate angle of the tapered gap provides an essentially jerk-free transport of the leading edge across the exposure gap.

Before the trailing edge of the single sheet reaches the first guide plate 13, the guide plate 13 is lifted into a position where it forms a tapered gap with the print drum. When the trailing edge reaches this guide plate, the trailing edge can lift off slightly from the print drum without jerking, conforming to the stress inherent in the paper. Because the second guide plate 14 positioned after the exposure gap is in the lower position, the trailing edge of the single sheet makes again approximate contact with the print drum after having passed the exposure gap.

With the arrangement according to the invention, single sheets can be exposed borderless from their leading edge to their trailing edge with excellent image quality.

It'll be understood that the invention is not limited to laser exposure devices for photographic paper. The invention can advantageously also be used in other devices where single sheets are printed borderless in a narrow processing gap. An exemplary apparatus is an inkjet printer for printing single sheets.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An apparatus for transporting single sheets through a device for exposing or printing the single sheets, including a drum, and a processing station having a processing gap, with each single sheet being exposed or printed in the processing station, and with means for transporting each sheet in a circular path past the processing gap, comprising at least one belt unit for pressing the single sheets against the drum, the belt unit including a plurality of parallel extending continuous belts that are mutually decoupled in their movement and that are driven exclusively through coupling with the drum surface, each of said belts having a curved portion conforming to the surface of said drum and/or a sheet pressed against the drum by the belt, whereby the speed of a belt is greater than the speed of said drum surface when a sheet is between the drum and belt so that a sheet being transported around the drum is not subject to unequal forces when it is engaged by fewer than all of said belts.

2. The apparatus according to claim 1, comprising an additional belt unit in the transport direction of the single sheets, said one belt unit positioned in front of the processing gap, the additional belt unit positioned behind the processing gap.

3. The apparatus according to claim 1, wherein the continuous belts are formed as flat belts.

4. The apparatus according to claim 1, wherein the belt unit for each continuous belts include two stationary deflection rollers and a deflection roller with a spatially adjustable rotation axis.

5. The apparatus according to claim 4, wherein a force is applied to the deflection roller with the spatially adjustable rotation axis in a direction that tensions the continuous belt.

6. The apparatus according to claim 4, wherein parallel deflection rollers are arranged on a respective common support.

7. The apparatus according to claim 4, wherein the stationary deflection rollers form a respective gap with the drum when the continuous belt is applied, with the gap being wider than the thickest single sheet to be processed.

8. The apparatus according to claim 2, wherein the belt unit, that is positioned in front of the processing gap in the transport direction, in conjunction with a stationarily installed deflection roller form with the drum a tapered receiving gap for the single sheets.

9. The apparatus according to claim 4, wherein the continuous belts between the stationary deflection rollers wrap around the drum with an angle of greater than 40 degrees.

10. The apparatus according to claim 1, wherein the drum has a diameter of at least 150 mm.

* * * * *